United States Patent [19]

Yang

[11] Patent Number: 4,732,417

[45] Date of Patent: Mar. 22, 1988

[54] DOOR HANDLE

[76] Inventor: Anthony L. Yang, 1639 E. Harmon Ave., #3, Las Vegas, Nev. 89119

[21] Appl. No.: 927,360

[22] Filed: Nov. 6, 1986

Related U.S. Application Data

[63] Continuation-in-part of Ser. No. 744,770, Jun. 14, 1985, abandoned.

[51] Int. Cl.[4] ..... E05C 1/14

[52] U.S. Cl. ..... 292/142; 292/336.3

[58] Field of Search ..... 292/142, 172, 112, 199, 292/336.3, 347

[56] References Cited

U.S. PATENT DOCUMENTS

| | | | |
|---|---|---|---|
| 1,071,567 | 8/1913 | Outwater | 292/142 X |
| 1,859,460 | 5/1932 | Peloguin | 292/142 X |
| 1,964,066 | 6/1934 | Kuszmaul | 292/172 X |
| 2,321,724 | 6/1943 | Aldeen et al. | 292/336.3 |
| 2,427,386 | 9/1947 | Claud-Mantle | 292/172 X |
| 2,862,750 | 12/1958 | Minke | 292/172 |

*Primary Examiner*—Richard E. Moore

*Attorney, Agent, or Firm*—Seiler, Quirk & Tratos

[57] ABSTRACT

A C-shaped door handle for replacing a conventional rotatable doorknob has mounting brackets at each end for attaching to a flat surface and a drive shaft adapted to engage a conventional latch-operating mechanism. The handle has an internal pivoted grip lever actuated by pulling the handle. Motion from the grip lever is transmitted to the rotary drive shaft by a rack and pinion transmission.

1 Claim, 13 Drawing Figures

DOOR HANDLE

RELATIONSHIP TO OTHER CASES

This application is a continuation-in-part of application Ser. No. 744,770, filed June 14, 1985, entitled DOOR HANDLE, now abandoned.

BACKGROUND OF THE INVENTION

This invention is related to a door handle which enables a conventional biased latch on the door to be opened by a single-step pulling action. More particularly, the invention relates to a C-shaped door handle which can be used to replace any standard rotating door knob by means of a very simple mechanical connection.

In general, three types of conventional door knobs are known in the art. The first type of prior art handle is L-shaped, having a member extending outwardly from the door and a horizontal grip member. To open the door, one must first grasp the L-shaped handle and rotate the handle to disengage the latch, thereafter pulling the handle to open the door. A multiple step operation comprising rotation of the handle and pulling of the handle is required to open the door. In addition, these door handles have a disadvantage of causing accidental damage to clothing which catches on the grip member. Similarly, a second type of door knob comprises a spherical or oval knob which must be gripped and rotated to disengage the latch, followed by pulling or pushing the door to open it. As with the L-shaped handle, successive actions of rotation and pulling are still required to open the door. The finish of the surface of round door knobs is often made smooth, and opening of these doors is sometimes difficult for children, disabled persons, or persons having wet hands.

The third type of prior art door handle has a C-shaped handle with an actuating lever that is operated by the user's thumb. The user grasps the arm portion of the handle and depresses the thumb lever, thereby retracting the door latch through a series of gears. To open the door, it is still necessary to perform two separate mechanical actions, namely, pressing down the thumb lever and pulling the door to open it. Substantial thumb pressure must be exerted to actuate this type of door handle, which is also difficult for children and handicapped persons. In addition, occasionally this type of handle is difficult for women who have long fingernails or manicured nail coatings. Accordingly, it is an object of the present invention to provide a C-shaped door handle which is capable of opening a door with only one single pulling action. It is another object of the invention to provide a door handle which can be easily used to replace existing door knobs by simply attaching the handle to the door panel, and inserting an actuating arm into the existing operating mechanism of the latch. These and other objects of the invention are accomplished by the door handle described herein.

BRIEF SUMMARY OF THE INVENTION

A decorative, C-shaped door handle has mounting members at each end thereof having coplanar mounting surfaces which fit flush against the surface of the door to which the handle is to be attached. A shaft extending forwardly from one of the mounting surfaces engages a conventional door latch actuating mechanism. The door handle has a pivotally mounted grip lever on an inside portion of the handle which is biased outwardly therefrom, which grip lever is operatively connected to the rotatable shaft by a rack and pinion gear mechanism.

BRIEF DESCRIPTION OF THE DRAWINGS

The invention is best understood with reference to the drawings in which:

FIG. 2 is a view showing the detailed construction of the transmission case of the handle;

DETAILED DESCRIPTION OF A PREFERRED EMBODIMENT

Figure 1:
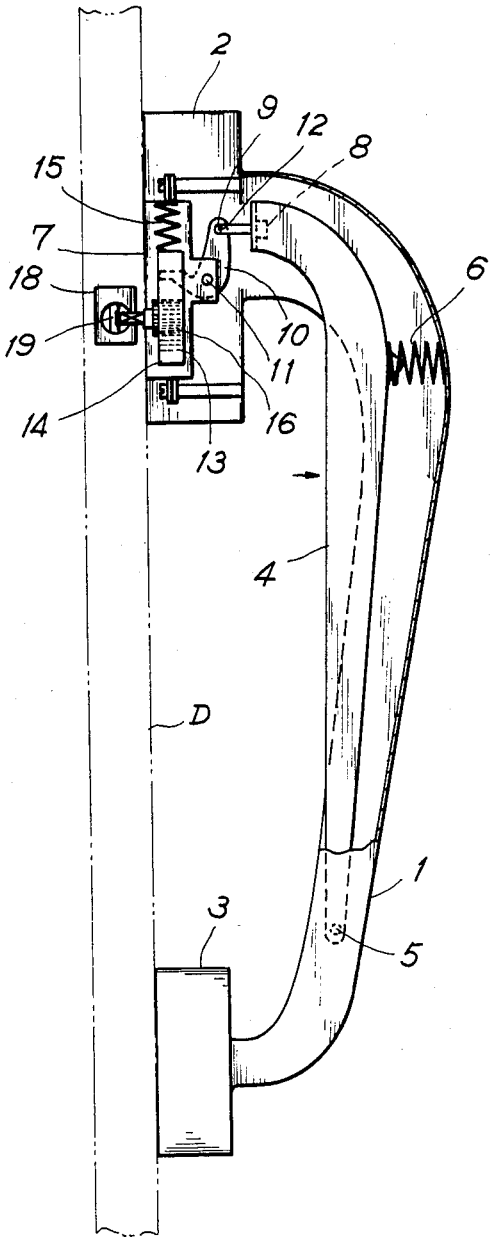
FIG. 1 is a side elevational view, partially sectioned, of the door handle of the invention.

Referring first to FIG. 1, door handle 1 is attached to an upper handle base 2 and a lower handle base 3. A grip lever 4 pivoted at its lower end 5 and encased within the handle body 1 is shown supported in its normal position by means of a retaining coil spring 6 which biases grip lever 4 away from the handle body 1 and toward the door frame D. A two-legged connecting rod 8 is attached at an upper portion of the grip lever 4 and has two bores 9 for connection to one end of a transmission cam 10 by means of a pin 12. The transmission cam 10 is rotatably pinned to the pair of projecting legs **7*a*1 of transmission case 7 by means of pin 11**.

Figure 2A:
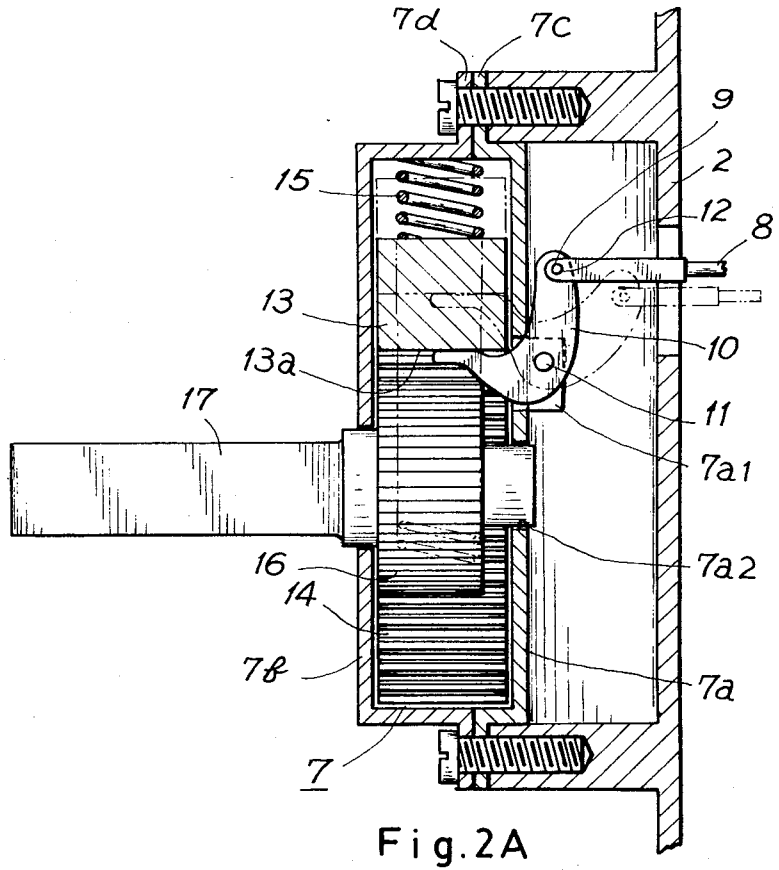
FIG. 2A is a section view thereof.
Figure 2B:
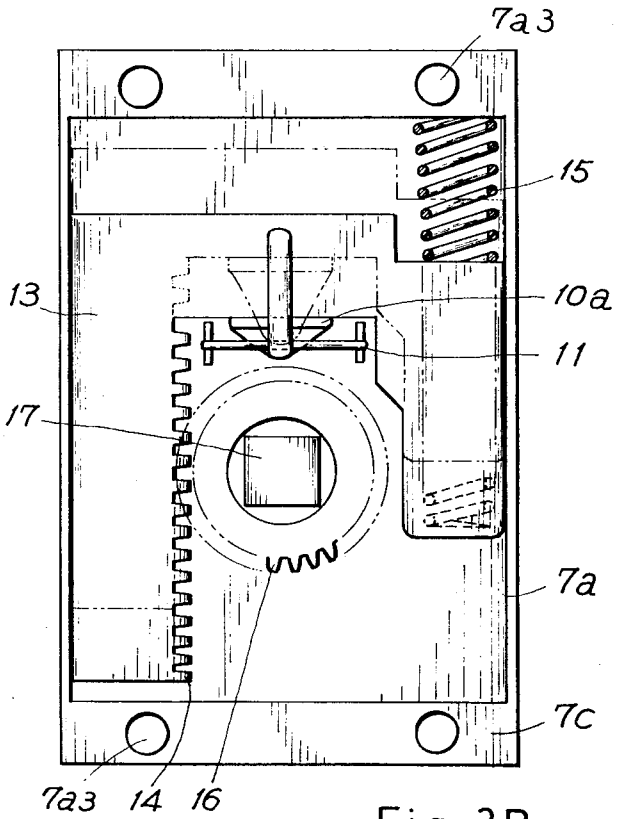
FIG. 2B is a front view thereof not showing the front half of the case.

FIGS. 2A and 2B show the details of the internal assembly of the transmission case 7. The rack plate 13 is vertically movable up and down within the transmission case by means of the transmission cam 10 and a helical extension spring 15 attached at one side of the rack plate 13. A pinion 16 having a central squared drive shaft meshes with the rack portion 14 of the rack plate 13 and drives the rack.

Figure 4A:
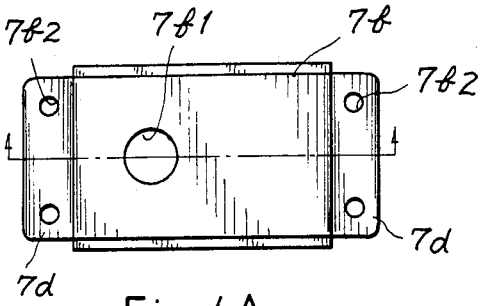
FIGS. 4A and 4B are a front plan view and side view, respectively, of the transmission case.
Figure 4E:
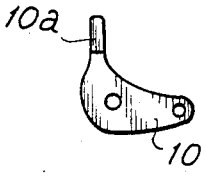
FIG. 4E shows a side view of the transmission cam.
Figure 4G:
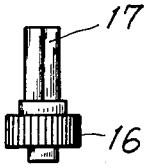
FIG. 4G shows a side view of the square shaft pinion unit.
Figure 4B:
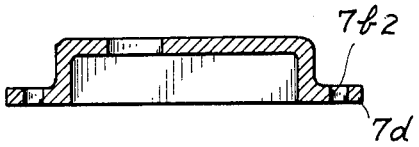
Figure 4F:
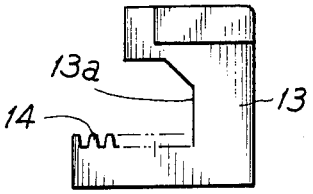
FIG. 4F shows a front view of the rack plate.
Figure 4C:
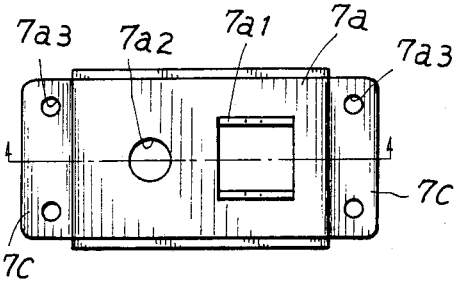
FIGS. 4C and 4D show a plan view of the rear half of the transmission case and a side sectional view thereof, respectively.

As shown in FIGS. 4A–4D, transmission case 7 consists of two casing portions **7*a* and 7*b* each having a plurality of registering bores 7*b*2 and 7*d* which mate with 7*a*3 and 7*c* as shown in FIG. 4C. Casing section 7*a* had two projecting lugs 7*a*1 each carrying a bearing hole for mounting a pin 11**.

FIG. 4F shows the details of rack plate 13 which has a rack portion 14 along the inner side of one leg which meshes with the teeth of pinion 16. The pinion is driven by a shaft 17 having a square cross section. The rack plate 13 is maintained in a normally downward position by compression spring 15 mounted above a leg portion of rack plate 13. The underside **13*a* of the center portion of rack plate 13** is a flat, smooth surface which abuts and is pushed upwardly thereby.

Figure 4H:
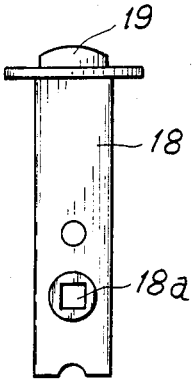
FIG. 4H shows a side view of the latch unit.
Figure 4D:
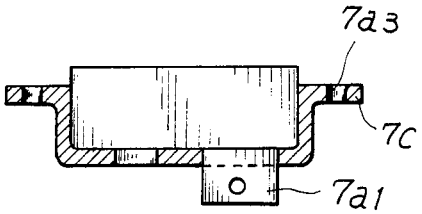

The pinion 16 is mounted in the transmission case 7, with the round portion of the pinion shaft extending through bearing bores **7*b*1 and 7*a*2, permitting the shaft to rotate freely. The pinion teeth mesh with the rack of rack plate 13. The square cross-sectional portion 17 of the drive shaft extends outwardly and forwardly of the mounting bracket 2, and constitutes the drive transmission which connects with the operating mechanism of a conventional door. As shown in FIG. 2A and 4G, the drive shaft 17 and the pinion 16 are formed into a unitary body with the square portion of the shaft being adapted to be inserted into the square opening 18***a* of the latch operating mechanism 18 (see FIG. 4H). The latch operating mechanism 18 retracts latch 19 for releasing the door from the door frame.

To install the door handle of the invention on the door frame D, the conventional L-shaped or spherical handle is first removed from the door, leaving the internal operating mechanism of the door intact. The upper handle base or mounting bracket 2 of the invention is placed over the opening in the door left by removal of the handle, and the drive shaft 17 is inserted into the square bore 18*a* of the latch operating mechanism of the door. The upper handle base 2 is then fixed to the door frame by means of screws. The lower handle base or mounting bracket 3 is then also attached to the door frame by means of screws or screw bolts affixed from the rear side of the door. Installation is very simple, because the mounting brackets 2 and 3 have planar mounting surfaces which are substantially coplanar with each other, thereby permitting the handle to be simply mounted on a flat door. The only member which extends outwardly into the door from the handle of the invention is the drive shaft which extends into the latch mechanism.

To open the door equipped with the door handle of the present invention, the user need only grip and pull the handle. The grip lever pivots around pivoted end 5 and is depressed inwardly as the handle is pulled, with the pulling force overcoming that of the compression spring 6. The two-legged connecting rod 8 attached at the top of the grip lever pulls the rotary transition transmission cam 10, which, in turn, rotates and lifts rack plate 13 upward by means of cam tip 10*a* which contacts and pushes the flat surface 13*a* of rack plate 13, thus overcoming the force exerted by compression spring 15. As the rack plate 13 rises, as shown by dotted lines in FIGS. 2A and 2B, it rotates pinion 16 which meshes with rack portion 14 of rack plate 13. As the pinion and drive shaft 17 rotate, the drive shaft retracts the latch 19 by means of the latch operating mechanism 18 which is preexisting in the door. Retraction of the latch 19 permits the door to be opened by the pulling force. Accordingly, the door is opened by simply grasping the handle and pulling.

Figure 3A:
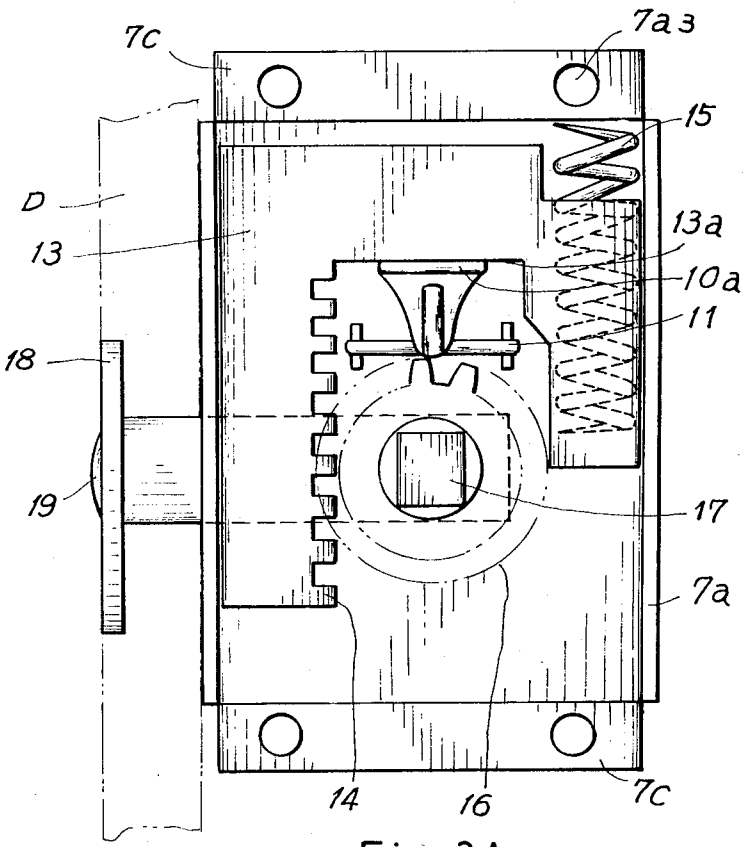
FIGS. 3A and 3B, respectively, show inside details of the transmission case portion of the handle showing the latch extended and the latch retracted.
Figure 3B:
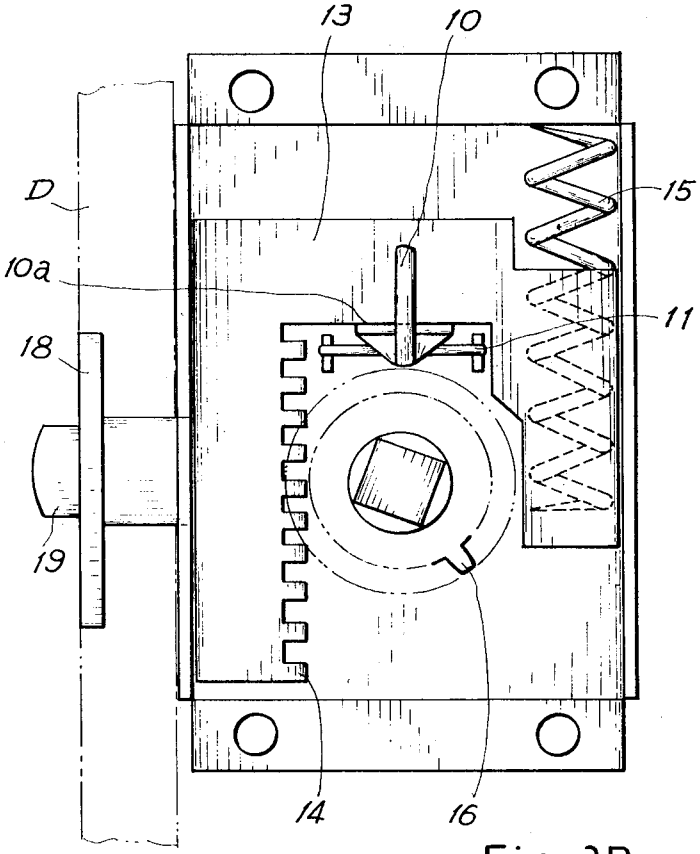

Upon releasing the grip from the handle, grip lever 4 returns to its original extended position due to the force of compression spring 6 mounted in the handle, as shown in FIG. 1. Reversing the original motion, the rack plate 13 thus returns to its original lowered position as shown in FIG. 3B, the rack plate being urged downwardly by compression spring 15. Downward movement of the rack reverses the rotation of the square drive shaft, thus returning the latch to its original extended or locked position as shown in FIG. 3D.

The operation of the door handle of the present invention is very simple and easy, requiring little force, and can be easily operated with a person having wet hands, or by children, or by handicapped persons. No rotating movement is required, and a person having slippery hands will have no difficulty gripping the handle. In addition, the conventional spherical, mushroom-type, knob-type, and L-shaped door handles can be easily replaced with the handle of the invention without making any alteration to the door frame. As previously indicated, the existing handle is dismounted from the door frame, and the square shaft 17 is simply inserted into the matching hole of the existing latch operating mechanism. The mounting brackets 2 and 3 are then tightly fastened to the door frame, and the handle is attached in a matter of minutes. Furthermore, the door handle may be installed on one side or both sides of a door without effecting its operation. The force necessary to open the door using the handle of the invention is as little as $\frac{1}{4}$–$\frac{1}{3}$ of that required to open a door using the conventional mushroom-type door handle. Accordingly, persons who have weak grips will have no difficulty opening doors using the handles of the invention. In addition, no extending members exist which can cause possible accidental injury or damage to clothing with the handles of the invention, and damage to fingernails is eliminated since the user's fingernails do not approach the operating mechanism of the handle.

The handle described in the foregoing Preferred Embodiment of the Invention is simply one example of the door handles of the invention, and should not be considered as limiting the invention. The particular types of gears and actuating mechanisms shown may be replaced by other actuating mechanisms, and the pinion 16 may be either totally circular or simply arcuate. The rotary transmission cam 10 may be a curved lever, or may be any other shape which performs the function in like manner. In addition, the biasing means 6 and 15 may be modified or relocated within the scope of the invention. In addition, additional components, parts, and changes, such as limiting devices for movement of the rotary transmission cam 10, the U-shaped rack plate 13, and the pinion means can be incorporated into the door handle to upgrade the operational performance. Such modifications would be clear to those skilled in the art having knowledge of the invention. Accordingly, the invention should be limited only by the following claims:

I claim:

1. A door handle comprising a C-shaped handle having upper and lower ends, a first mounting member comprising a hollow casing located at one end of the C-shaped handle having a planar mounting surface adapted to abut and engage a flat vertical surface of a door, a grip lever pivotally mounted with the C-shaped handle and biased outwardly from said handle, a rotatable shaft extending forwardly from the planar mounting surface of the first mounting member and being adapted to engage an actuation mechanism of a conventional door latch, and actuating means housed within the first mounting member operably connection the grip lever and the rotatable shaft such that movement of the grip lever toward the C-shaped handle rotates the shaft, said actuating means including a lever arm activated by the grip lever and a rack and pinion mechanism operatively connected to the lever arm.

* * * * *